US008247743B2

(12) United States Patent
Sherbert

(10) Patent No.: US 8,247,743 B2
(45) Date of Patent: Aug. 21, 2012

(54) COOKING APPLIANCE HAVING A BROILING ELEMENT WITH LOOPS OF NON-UNIFORM LENGTH

(75) Inventor: Kevin W. Sherbert, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 11/703,560

(22) Filed: Feb. 6, 2007

(65) Prior Publication Data

US 2009/0261087 A1 Oct. 22, 2009

(51) Int. Cl.
*A21B 1/22* (2006.01)
*F27D 11/02* (2006.01)

(52) U.S. Cl. ..... 219/409; 219/538

(58) Field of Classification Search ..... None
See application file for complete search history.

(56) References Cited

U.S. PATENT DOCUMENTS

| | | | | |
|---|---|---|---|---|
| 4,506,652 | A | 3/1985 | Baker et al. | |
| 4,629,865 | A * | 12/1986 | Freedman et al. | 219/409 |
| 7,378,617 | B1 * | 5/2008 | Brockman | 219/409 |
| 2001/0020612 | A1 * | 9/2001 | Wurm et al. | 219/409 |
| 2006/0049183 | A1 * | 3/2006 | Eke et al. | 219/681 |

* cited by examiner

*Primary Examiner* — Joseph M Pelham
(74) *Attorney, Agent, or Firm* — James E. Howard; Andre Pallapies

(57) ABSTRACT

An electric resistance heating element for an oven is provided. The electric resistance heating element includes a sinuous-shaped element having a front side flank portion and a front side flank portion and at least one front side interior portion. The at least one front side interior portion is disposed intermediate the front side flank portion and the front side flank portion as viewed in a width direction perpendicular to the depth direction of the oven from the front of the oven to the rear of the oven and the front side flank portion and the front side flank portion each being located closer to the front of the oven than the at least one front side interior portion.

10 Claims, 6 Drawing Sheets

COOKING APPLIANCE HAVING A BROILING ELEMENT WITH LOOPS OF NON-UNIFORM LENGTH

BACKGROUND OF THE INVENTION

The invention disclosed herein relates generally to cooking appliances, and more particularly to a cooking appliance having a broiling element with loops of non-uniform length.

Foodstuffs may be baked or broiled inside the heated space of an oven, stove, or range (hereinafter "ovens" for simplicity) via placement of the foodstuffs on a cooking vessel such as, for example, on a broiling tray. U.S. Pat. No. 4,506,652 discloses an automatic oven for heating foodstuffs, i.e. cooking pizza, that has a heated enclosure substantially L-shape in plan to leave an exposed sector. A rotor is turned intermittently by power to carry pizzas from the exposed sector, through the heated enclosure and back to the exposed sector. In the heated enclosure the pizzas are baked by a stream of heated and reheated air circulated in a closed path. Electric radiant heaters 57 and 58 are provided for heating items individually deposited on a grid 31 as these items are rotated under the electric radiant heaters 57 and 58 in the exposed sector or quadrant.

FIG. 2 of U.S. Pat. No. 4,506,652 shows that the electric radiant heater 57 is of a sinuous shape and has a loop that extends further toward one side of the oven than another loop of the electric radiant heater. While the oven disclosed in U.S. Pat. No. 4,506,652 may be effective for the particular heating effect desired to be imparted to a foodstuff as the foodstuff such as a pizza is rotated past various heating elements, there remains a need to provide, with respect to ovens in which foodstuffs are stationary during a cooking process, an arrangement for ensuring that foodstuffs are subjected to a more uniform degree of baking relative to one another than if a food cooking vessel on which such foodstuffs are supported in a stationary manner within an oven were instead supported above a conventional baking element.

SUMMARY OF THE INVENTION

According to one aspect of the present invention, there is provided an electric resistance heating element for an oven, the oven having an access opening that is selectively opened and closed by an oven door and which defines the front of the oven. The electric resistance heating element includes a sinuous-shaped element having a front side flank portion and a front side flank portion and at least one front side interior portion. The at least one front side interior portion is disposed intermediate the front side flank portion and the front side flank portion as viewed in a width direction perpendicular to the depth direction of the oven from the front of the oven to the rear of the oven and the front side flank portion and the front side flank portion each being located closer to the front of the oven than the at least one front side interior portion.

In accordance with further details of the one aspect of the present invention, the at least one front side interior portion is comprised of a pair of front side interior portions and the front side flank portions and the front side interior portions are semi-cylindrical in shape. Additionally, the front side flank portions are located such that, for each of the front side flank portions, the midpoint thereof along the semi-cylindrical extent of the front side interior portion—which is the location of the front side interior portion closest to the front of the oven—is at the same stand off spacing from the opening access of the oven as the other front side interior portion and the front side interior portions are located such that, for each of the front side interior portions, the midpoint thereof along the semi-cylindrical extent of the front side interior portion is at the same deep pushback spacing from the opening access of the oven as the other front side interior portion.

According to another aspect of the present invention, an oven is provided. The oven includes a cooking chamber in which a cooking vessel can be disposed for heating of food or other substances retained on the cooking vessel, an oven door, an access opening that is selectively opened and closed by the oven door and which defines the front of the oven, and an electric resistance heating element. The electric resistance heating element has a sinuous-shape and has a front side flank portion and a front side flank portion and at least one front side interior portion. The at least one front side interior portion is disposed intermediate the front side flank portion and the front side flank portion as viewed in a width direction perpendicular to the depth direction of the oven from the front of the oven to the rear of the oven and the front side flank portion and the front side flank portion each being located closer to the front of the oven than the at least one front side interior portion.

It is therefore an object to provide a cooking appliance having a broiling element with loops of non-uniform length for ensuring that foodstuffs are subjected to a more uniform degree of baking relative to one another than if a food cooking vessel on which such foodstuffs are supported in a stationary manner within an oven were instead supported above a conventional baking element.

An object of the present invention having been stated hereinabove, and which is addressed in whole or in part by the present invention, other objects will become evident as the description proceeds when taken in connection with the accompanying drawings as best described hereinbelow.

DETAILED DESCRIPTION OF THE INVENTION

Figure 1:
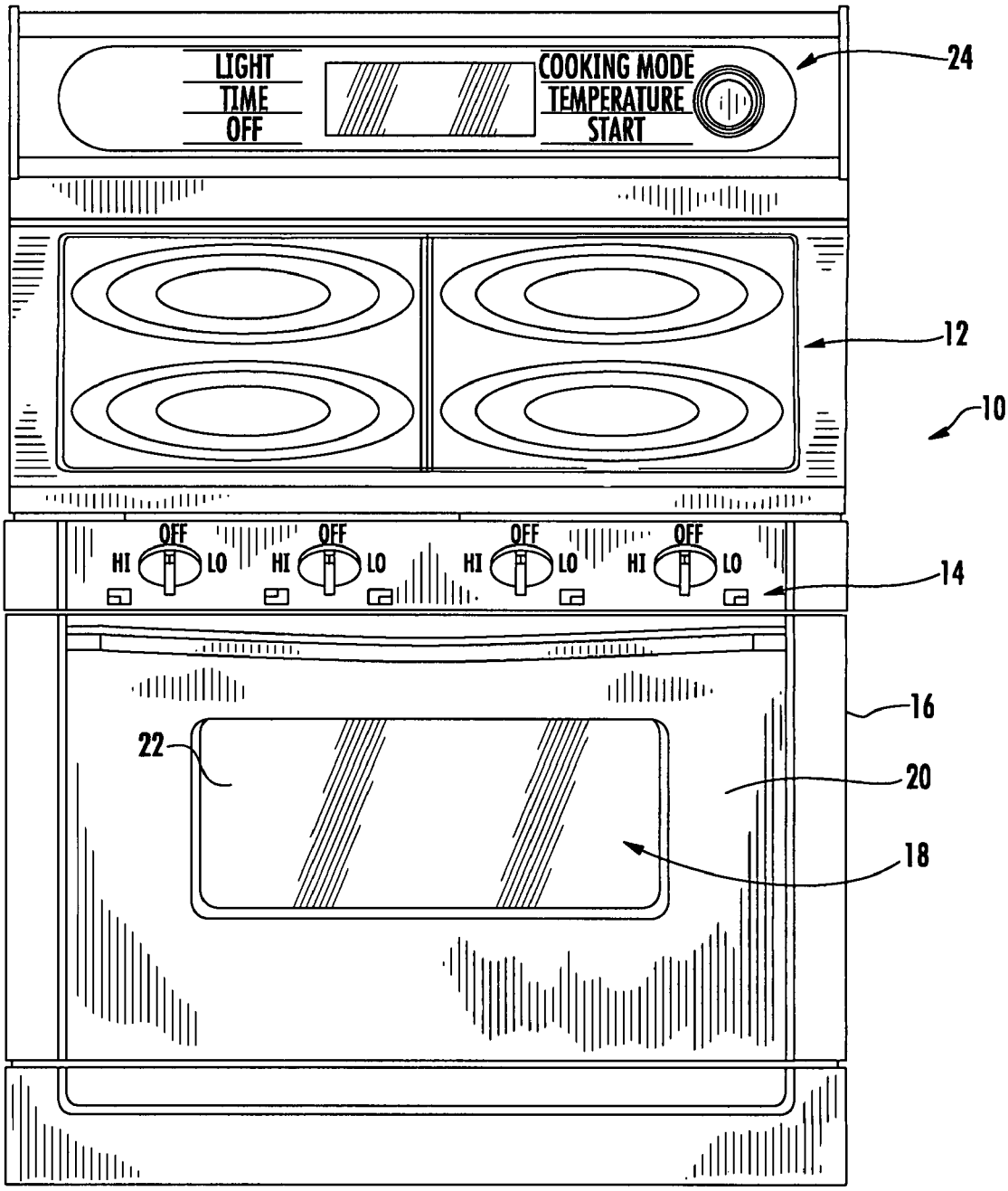
FIG. 1 is a perspective view of an oven having conventional baking elements.
Figure 2:
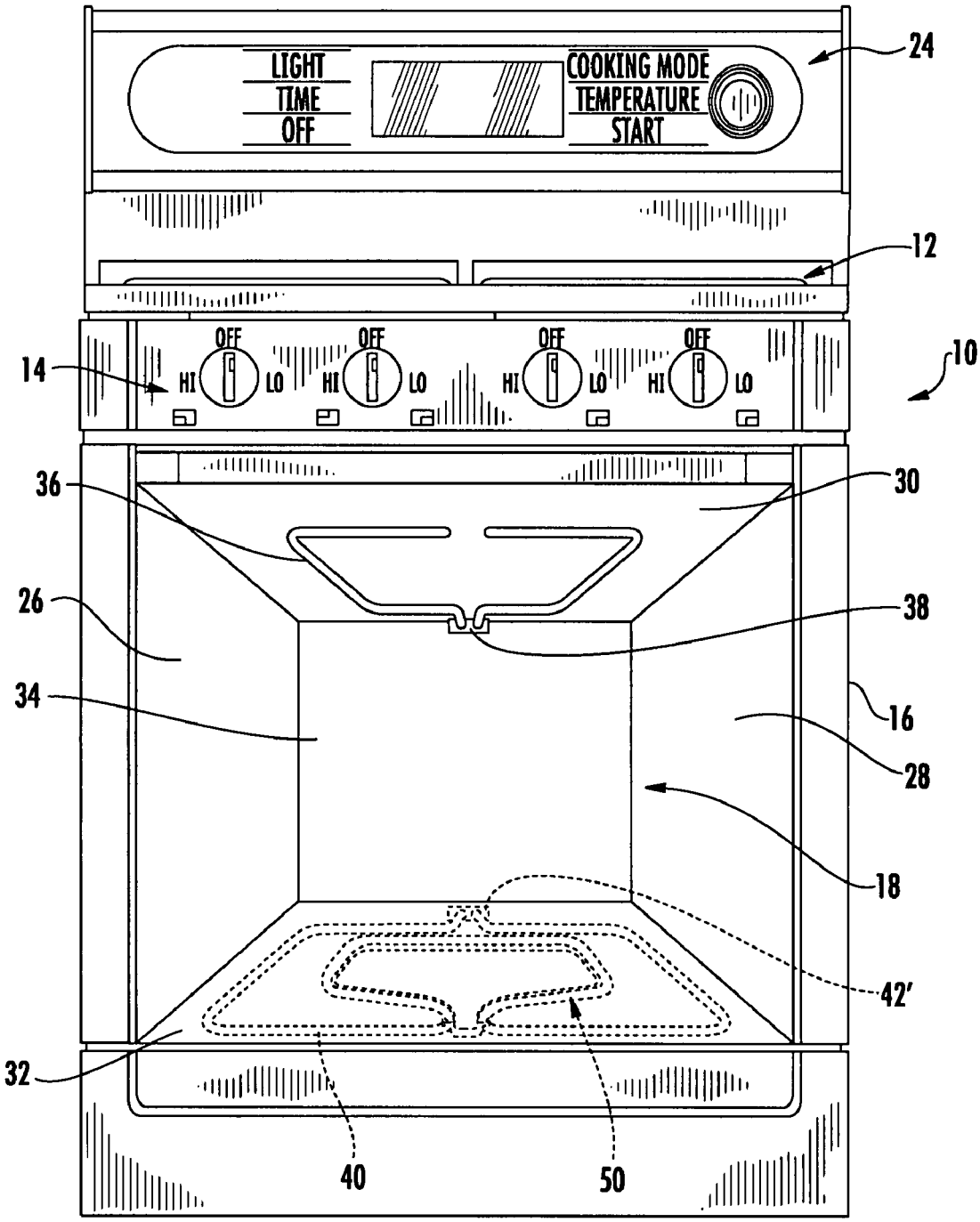
FIG. 2 is a front plan view of the oven of FIG. 1 including a schematic view of one location of the heating element shield of the present invention.

Referring now to FIGS. 1 and 2, an electric oven or range 10 ("oven" is used for ease of reference hereinafter), such as a free standing range as illustrated or a built in oven (not illustrated), includes conventional broiling elements and the broiling element with loops of non-uniform length of the present invention can be installed in such an oven 10 ("oven" is used for ease of reference hereinafter) in lieu of such conventional broiling elements, as will be described in more detail hereinafter. The oven 10 includes a range top 12 and an associated control panel 14 for the burners of the range top 12. The oven 10 includes a frame 16, with an oven cavity 18 in the lower portion thereof below the range top 12 as is conventional when such a range top 12 is included with the oven 10. The oven cavity 18 is closed by an oven door 20, which generally can include a window 22 for the user to view the inside of the oven cavity 18, such as to view food cooking in the oven cavity 18. The operation of the oven cavity 18 is controlled by the user utilizing a second control panel 24. The self-cleaning operation of the oven cavity 18 is controlled by operation of the control panel 24.

With reference to FIG. 2, the oven cavity 18 generally has side walls 26 and 28, a top wall 30, a bottom wall 32, and a back wall 34. In the immediate vicinity of the top wall 30, an interior or broil heating element (resistance coil) 36 can be disposed for grilling or broiling. The broil heating element 36 can be of any heating element known in the art and is in contact with a plug 38, for example, or another type of connecting element through its electrical terminals. Below the bottom wall 32 of the oven cavity 18, an external or bake heating element 40 is disposed and is in contact with another plug 42, for example, or another type of connecting element through its electrical terminals. The broiling element with loops of non-uniform length of the present invention may be provided in lieu of the conventional broil heating element, such as, for example, the broil heating element 36 described hereinabove, or in lieu of an external broil heat element, such as, for example, the bake heating element 40 described hereinabove.

Figure 3:
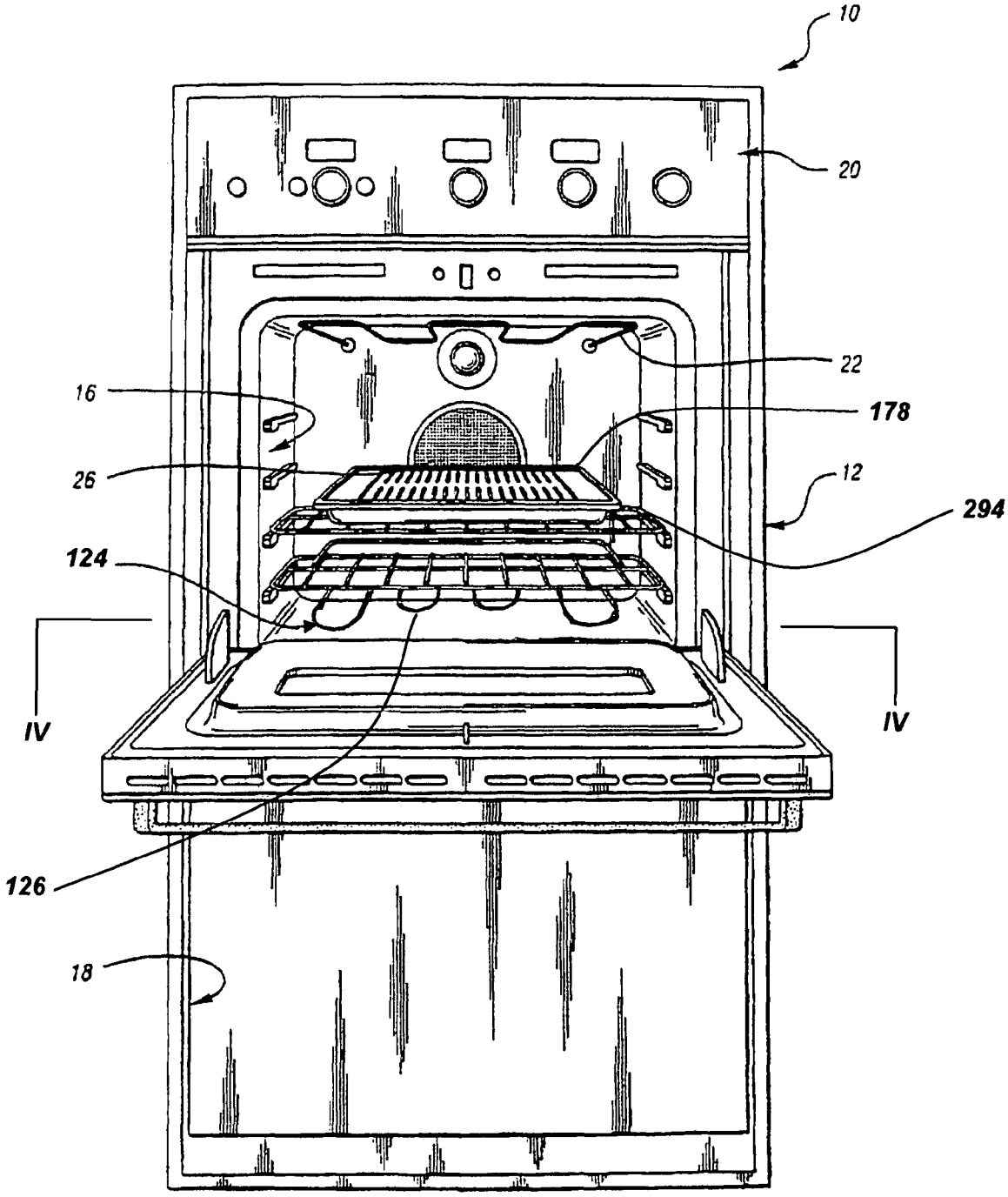
FIG. 3 is an enlarged front view of the cooking appliance described with respect to FIG. 1 and modified to comprise one embodiment of the broiling element with loops of non-uniform length of the present invention.

Reference is now had to FIG. 3, which is an enlarged front view of the cooking appliance described with respect to FIG. 1 and modified to now comprise a broiling element with loops of non-uniform length. A broiling element with loops of non-uniform length, hereinafter generally designated as lower non-uniform baking element 126, is installed in lieu of the conventional lower baking element 24 described with respect to FIG. 1. The non-uniform baking element 126 is particularly configured with respect to the interior volume of oven chamber 18 and with respect to an oven rack 176 that is supported by the oven 12 above the non-uniform baking element 126 such that the non-uniform baking element 126 advantageously distributes heat to a food cooking vessel, such as, a food cooking vessel 178.

Referring now more particularly to FIG. 3, a cooking appliance 110 modified to comprise one embodiment of the broiling element with loops of non-uniform length of the present invention is shown and the cooking appliance 110 includes an oven 112 with a plurality of cooking energy sources in communication with the cooking chamber 116. The cooking appliance 110 includes a control panel 120 and enables the user to provide input, preferably to a microprocessor-based control system that automatically operates one or more cooking energy sources in a predetermined, controlled manner to perform a complete cooking process.

While the control panel 120 is incorporated as a structural portion of the appliance in the preferred embodiment, it is to be understood the control and the switches actuated by the user may be physically external to the appliance, for example, a universal control for all appliances in a room or building, and may also incorporate remote control technology that does not require a user's presence immediately in front of the appliance. The cooking energy source for the oven 110 includes a baking cooking source, such as the source including heating elements such as the upper broiler heating element 122 and a lower baking element 24. The baking and broiling features may be further enhanced where a convection fan is employed during operation of one or more of the heating elements such as, for example, a convection fan associated with a convection thermal cooking source 126 that has a heating element associated with the fan and operated independently of the baking elements 122 and 124.

The control panel 120 includes tactile switches, preferably in the form of touch sensing switches covered by a face panel to limit exposure of the active switch components and to avoid protruding switch parts through the panel. The control panel 120 controls the execution of programs that automatically set operating parameters for and actuates at least one, and preferably a combination of cooking energy sources, including the temperature or power rating of the source, and the time period for each action of the combination of sources, temperatures, and power levels, in response to a limited input of information from the user. A selected category of food and setting of the time corresponding to a recommended cooking time for a conventional lower element baking of a particular recipe of the food item to be cooked is selected, although it is to be understood that the time may also be adjusted for degrees of doneness or browning that may be desired by a user, or may be subject to changes depending on the types of cooking energy sources conventionally recommended or applied to the food item to be prepared.

Figures 4, 7:
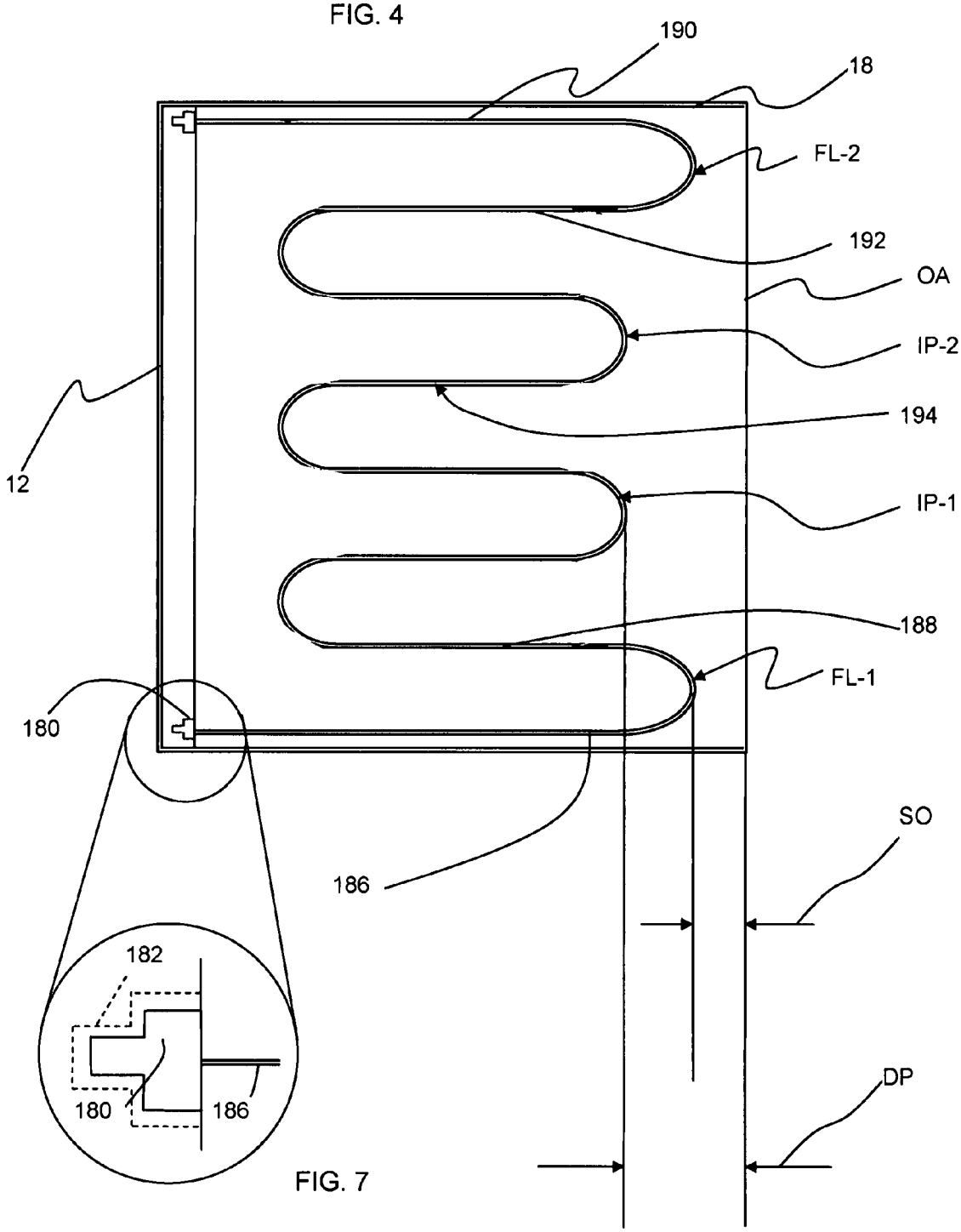
FIG. 4 is an enlarged top plan sectional view, taken along line IV-IV of FIG. 3, of the one embodiment of the broiling element with loops of non-uniform length shown in FIG. 3.
FIG. 7 is an enlarged top plan view of a portion of the one embodiment of the broiling element with loops of non-uniform length shown in FIG. 4.

When a selected cooking process mode is selected via the control panel 120, the appliance control will preheat the operative thermal elements including the one embodiment of the broiling element with loops of non-uniform length of the present invention, hereinafter generally designated as lower non-uniform baking element 126 that is comprised as part of the lower baking element 124. The lower non-uniform baking element 126 is installed in lieu of the conventional lower baking element 24 described with respect to FIG. 1. After the oven is preheated, the user places food in the oven 116 and the food is cooked for the actual cooking time, and the actual cook time is then displayed at window As shown in FIG. 4, which is an enlarged top plan sectional view, taken along line IV-IV of FIG. 3, of the one embodiment of the non-uniform baking element 126 of the present invention, the non-uniform baking element 126 has a pair of plugs 180 spaced from one another and each is configured to be received in a conventional plug receptacle 182 located in the rear portion of the oven 18 such that the non-uniform baking element 126 is provided with electrical current via the plug receptacles, whereupon the non-uniform baking element 126 gives off heat generated via resistance of the non-uniform baking element 126 to the current flowing therethrough.

The non-uniform baking element 126 is formed of a single continuous wire having one end operatively connected to a plug 180 and another end operatively connected to the other plug 180. The non-uniform baking element 126 extends in a sinuous path between the pair of plugs 180 and is specifically configured such that certain portions thereof are closer to, or more proximate to, the front of the oven 12, which is deemed to be the side of the oven 12 whereat the opening access OA is formed that is selectively opened and closed by the oven door, than other portions of the non-uniform baking element 126.

The non-uniform baking element 126 includes a pair of front side flank portions FL-1, FL-2 and a pair of front side interior portions IP-1, IP-2 with the front side flank portions FL-1, FL-2 and the front side interior portions IP-1, IP-2 being semi-cylindrical in shape. The front side flank portion FL-1 has one end thereof seamlessly formed with an end of a linear portion 186 of the non-uniform baking element 126.

The linear portion 186 extends in straight line manner between a remote end thereof that is operatively connected to a plug 180 and the proximate end thereof that is seamlessly formed with the one end of the front side flank portion FL-1 The front side flank portion FL-1 includes another end seamlessly formed with an interconnecting portion 188 that extends in a direction from the front of the oven 12 toward the rear of the oven 12 and thereafter extends in a direction from the rear of the oven 12 toward the front of the oven 12, whereat the interconnecting portion 188 is seamlessly interconnected with an end of the front side interior portion IP-1.

The front side flank portion FL-2 has one end thereof seamlessly formed with an end of a linear portion 190 of the non-uniform baking element 126. The linear portion 190 extends in straight line manner between a remote end thereof that is operatively connected to the other plug 180 and the proximate end thereof that is seamlessly formed with the one end of the front side flank portion FL-2. The front side flank portion FL-2 includes another end seamlessly formed with an interconnecting portion 192 that extends in a direction from the front of the oven 12 toward the rear of the oven 12 and thereafter extends in a direction from the rear of the oven 12 toward the front of the oven 12, whereat the interconnecting portion 192 is seamlessly interconnected with an end of the front side interior portion IP-2. A center connecting portion 194 interconnects the front side interior portion IP-1 and the front side interior portion IP-2 and this center connecting portion 194 extends from one end of the front side interior portion IP-1 in a direction from the front of the oven 12 toward the rear of the oven 12 and thereafter extends in a direction from the rear of the oven 12 toward the front of the oven 12, whereat the center connecting portion 194 is seamlessly formed with an end of the front side interior portion IP-2.

The non-uniform baking element 126 is configured such that the front side flank portion FL 1 and the front side flank portion FL-2 each are located closer to, or more proximate to, the front of the oven 12 than either of the front side interior portions IP-1, IP-2. In the one embodiment of the non-uniform baking element 126 shown in FIGS. 30 and 31, the front side flank portion FL-1 and the front side flank portion FL-2 are located such that, for each of the front side flank portion FL-1 and front side flank portion FL-2, the midpoint thereof along the semi-cylindrical extent of the front side interior portion—which is the location of the front side interior portion closest to the front of the oven 12—is at the same stand off spacing SO from the opening access OA of the oven 12 as the other front side interior portion. The front side interior portions IP-1, IP-2 are located such that, for each of the front side interior portions IP-1, IP-2, the midpoint thereof along the semi-cylindrical extent of the front side interior portion which is the location of the front side interior portion closest to the front of the oven 12—is at the same deep pushback spacing DP from the opening access OA of the oven 12 as the other front side interior portion.

The extent of the deep pushback spacing DP of each of the front side interior portions IP-1, IP-2 from the opening access OA of the oven 12 is, as measured in a direction from the front of the oven 12 toward the rear of the oven 12, a greater extent than the stand off spacing SO of each of the front side flank portions FL-1, FL-2 from the opening access OA of the oven 12. This relationship between the deep pushback spacing DP of each of the front side interior portions IP-1, IP-2 and the stand off spacing SO of each of the front side flank portions FL-1, FL-2 results in a configuration of the non-uniform baking element 126 that promotes more uniform heat distribution by the non-uniform baking element 126 to the food or other substance being heated in the vessel 178.

Figure 5:
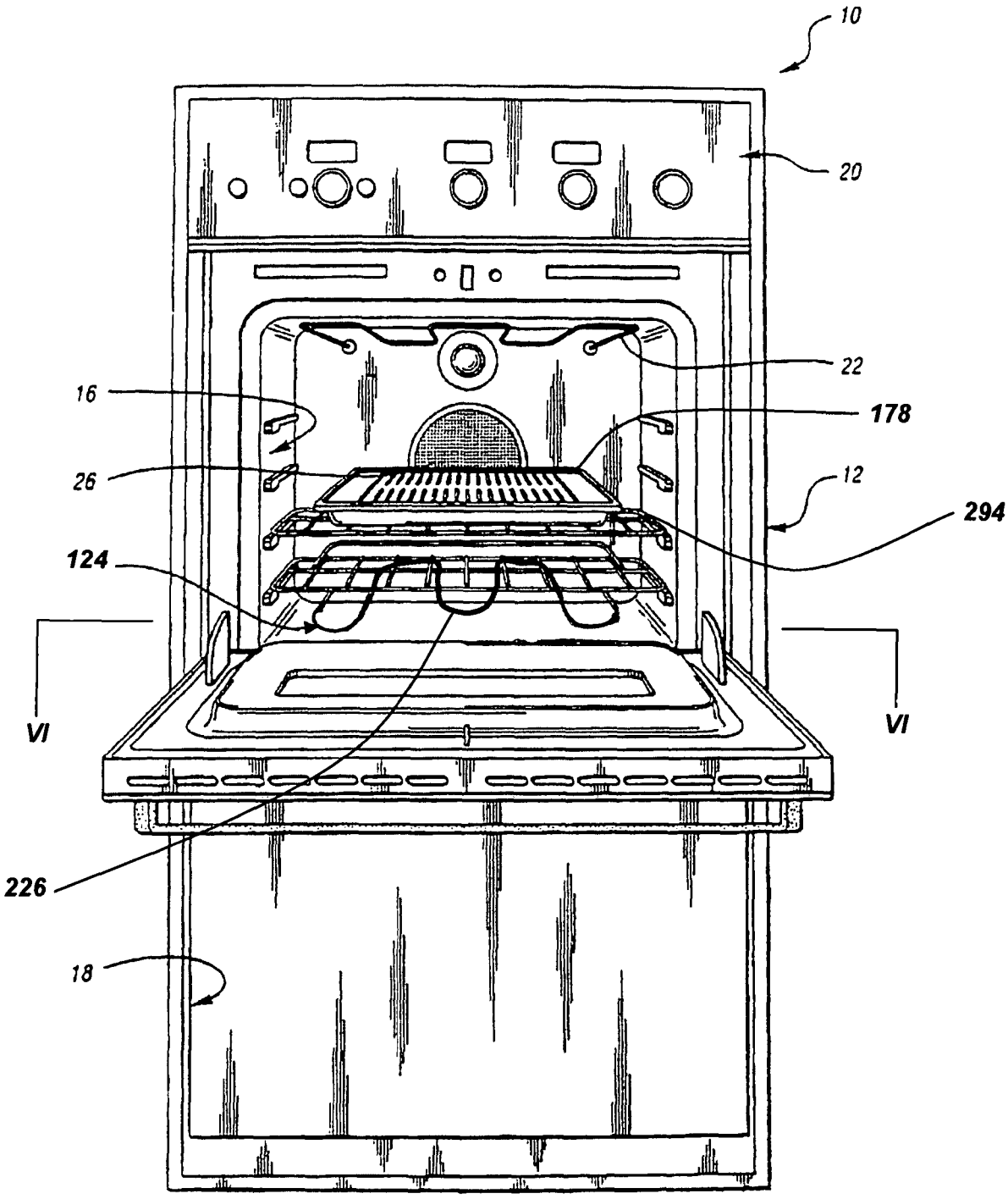
FIG. 5 is an enlarged front view of the cooking appliance described with respect to FIG. 1 and modified to comprise another embodiment of the broiling element with loops of non-uniform length of the present invention.
Figure 6:
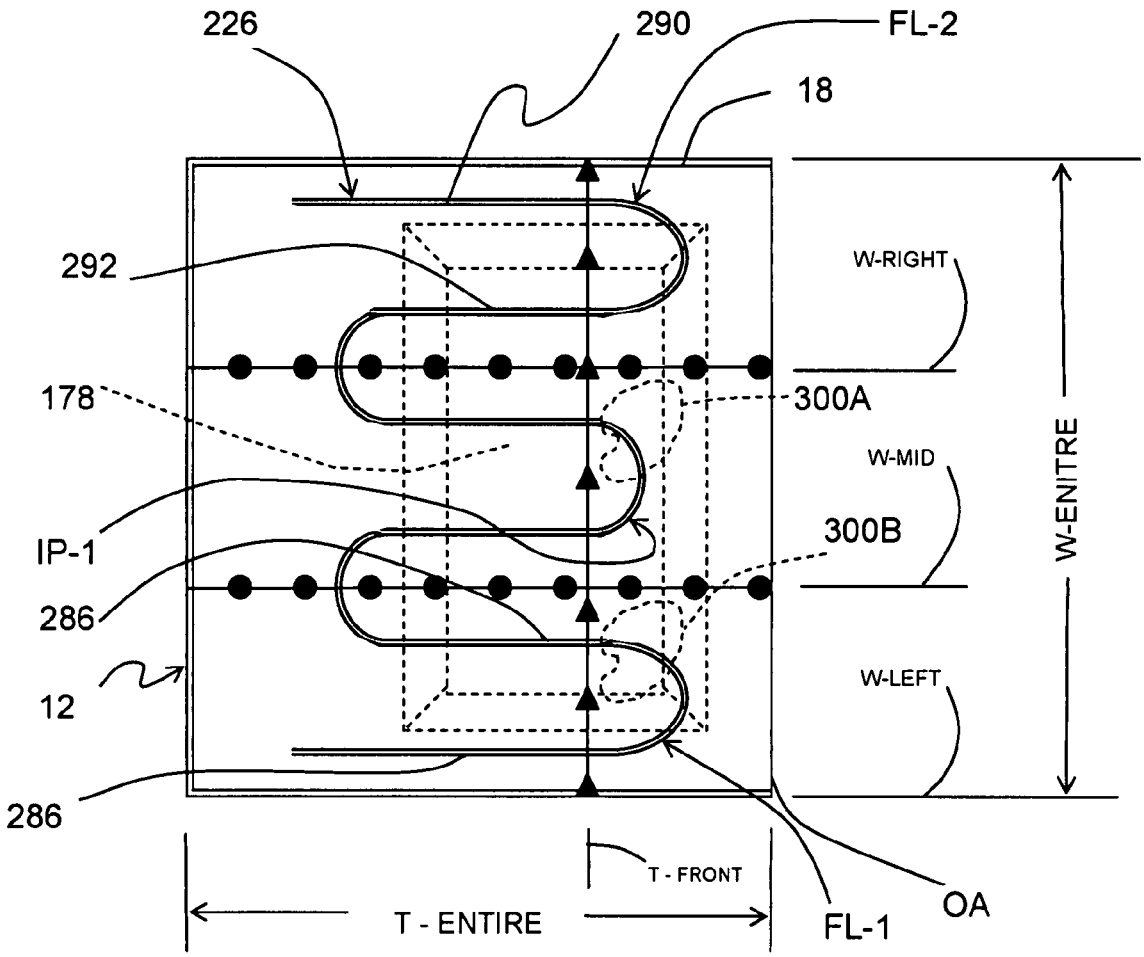
FIG. 6 is an enlarged top plan sectional view, taken along line VI-VI of FIG. 5, of another embodiment of the broiling element with loops of non-uniform length of the present invention.

Another configuration of the baking element of the present invention having a broiling element with loops of non-uniform length is shown in FIGS. 5 and 6 and is hereinafter generally designated as lower non-uniform baking element 226. This lower non-uniform baking element 226 can be is installed in lieu of the conventional lower baking element 24 described with respect to FIG. 1. As seen in FIG. 5, which is an enlarged front view of the cooking appliance described with respect to FIG. 1 modified to comprise the lower non-uniform baking element 226, and FIG. 6, which is an enlarged top plan sectional view, taken along line VI-VI of FIG. 5, of the lower non-uniform baking element 226, the lower non-uniform baking element 226 is formed of a single continuous wire having one end operatively connected to a plug 280 and another end operatively connected to the other plug 280. The non-uniform baking element 226 extends in a sinuous path between the pair of plugs 280 and is specifically configured such that certain portions thereof are closer to, or more proximate to, the front of the oven 12, which is deemed to be the side of the oven 12 whereat the opening access OA is formed that is selectively opened and closed by the oven door, than other portions of the non-uniform baking element 226.

The non-uniform baking element 226 includes a pair of front side flank portions FL-1, FL-2 and a single front side interior portions IP-1 with the front side flank portions FL-1, FL-2 and the front side interior portion IP-1 being semi-cylindrical in shape. The front side flank portion FL-1 has one end thereof seamlessly formed with an end of a linear portion 286 of the non-uniform baking element 226. The linear portion 286 extends in straight line manner between a remote end thereof that is operatively connected to a plug 280 and the proximate end thereof that is seamlessly formed with the one end of the front side flank portion FL-1. The front side flank portion FL-1 includes another end seamlessly formed with an interconnecting portion 288 that extends in a direction from the front of the oven 12 toward the rear of the oven 12 and thereafter extends in a direction from the rear of the oven 12 toward the front of the oven 12, whereat the interconnecting portion 288 is seamlessly interconnected with an end of the front side interior portion IP-1.

The front side flank portion FL-2 has one end thereof seamlessly formed with an end of a linear portion 290 of the non-uniform baking element 226. The linear portion 290 extends in straight line manner between a remote end thereof that is operatively connected to the other plug 280 and the proximate end thereof that is seamlessly formed with the one end of the front side flank portion FL-2. The front side flank portion FL-2 includes another end seamlessly formed with an interconnecting portion 292 that extends in a direction from the front of the oven 12 toward the rear of the oven 12 and thereafter extends in a direction from the rear of the oven 12 toward the front of the oven 12, whereat the interconnecting portion 292 is seamlessly interconnected with an end of the front side interior portion IP-1.

With reference to FIG. 6, a description will now be provided of the manner in which the non-uniform baking element 226 advantageously distributes heat to a food cooking vessel, such as, a food cooking vessel 178. The exemplary cooking operation involves the placement of the food cooking vessel 178 on a selected rack of the oven 12, such as, for example as seen in FIG. 3, on an oven rack 294 and the food cooking vessel 178 is performing in the conventional role of supporting and retaining foodstuffs—specifically, a foodstuff 300A and a foodstuff 300B—while these foodstuffs are baked by the oven 12.

The placement of the food cooking vessel 178 on the oven rack 294 is such that foodstuffs 300A is supported above a portion of the IP-1 and foodstuffs 300B is supported above a portion of FL-1. This placement of the food cooking vessel 178 on the oven rack 294 results in both foodstuffs 300A and foodstuffs 300B being supported in the front-most one-third of the oven 12—in other words, both foodstuffs 300A and foodstuffs 300B are supported between an imaginary demarcation line T—front that delimits or demarcates the front-most one-third of the oven 12 in the depth direction T—entire of the oven 12, with the front of the oven 12 being deemed to be the access opening OA. Additionally, this given placement of the food cooking vessel 178 on the oven rack 294 results in the foodstuffs 300A being supported in the widthwise middle one-third of the oven 12—in otherwords, if the width of the oven 12 as measured parallel to the access opening OA is divided into equal one-third segments demarcated by imaginary lines W-right, W-mid, and W-left, then the foodstuffs 300A is supported between the imaginary demarcation line W-mid and the imaginary line W-left. Furthermore, this given placement of the food cooking vessel 178 on the oven rack 294 results in the foodstuffs 300B being supported in the widthwise left-hand one-third of the oven 12—in other words, the foodstuffs 300B is supported between the imaginary demarcation line W-left and the left hand wall of the oven 12.

The non-uniform baking element 226 ensures that both of the foodstuffs foodstuffs 300A and foodstuffs 300B are subjected to a more uniform degree of baking relative to one another than if the food cooking vessel 178 were instead disposed on the oven rack 294 and supported above a conventional baking element arrangement such as the lower baking element 24 described with respect to FIG. 1. One reason for this more uniform degree of baking of the foodstuffs 300A and foodstuffs 300B may be the combined effects of the radiant and convective heating properties that are created in the oven 12 provided with the non-uniform baking element 226 in contrast to the combined effects of the radiant and convective heating properties that are created in the oven 12 provided with a conventional baking element arrangement such as the lower baking element 24.

It will be understood that various details of the present invention may be changed without departing from the scope of the present invention. Furthermore, the foregoing description is for the purpose of illustration only, and not for the purpose of limitation, as the present invention is defined by the claims as set forth hereinafter.

What is claimed is:

1. An oven comprising:

a cooking chamber in which a cooking vessel can be disposed for heating of food or other substances retained on the cooking vessel, the cooking chamber having a front-most one-third portion, a middle one-third portion, and a rear-most one-third portion in a depth direction of the cooking chamber, the cooking chamber having a left-most one-third portion, a center one-third portion, and a right-most one-third portion in a width direction of the cooking chamber;

an oven door;

an access opening that is selectively opened and closed by the oven door and which defines the front of the cooking chamber of the oven; and an electric resistance heating element disposed in a lower-most portion of the oven, the electric resistance heating element comprising:

a sinuous-shaped, lower baking element formed only by a single continuous wire coupled at a first end to a first plug and at a second end to a second plug, the sinuous-shaped, lower baking element having a first front side flank portion and a second front side flank portion and at least one front side interior portion, the at least one front side interior portion being disposed intermediate the first front side flank portion and the second front side flank portion as viewed in the width direction perpendicular to the depth direction of the cooking chamber of the oven from the front of the cooking chamber of the oven to the rear of the cooking chamber of the oven and the first front side flank portion and the second front side flank portion each extending closer to the front of the cooking chamber of the oven than the at least one front side interior portion, wherein each of the first front side flank portion, the second front side flank portion, and the at least one front side interior portion includes a semi-circular extent that extends in the depth direction from the rear of the cooking chamber of the oven toward the front of the cooking chamber of the oven and thereafter extends in the depth direction from the front of the cooking chamber of the oven toward the rear of the cooking chamber of the oven, and wherein an entire length of the semi-circular extent of the at least one front side interior portion is located only in the front-most one-third portion of the oven in the depth direction such that food or other substances retained on the cooking vessel in the front-most one-third portion in the depth direction and one of the left-most one-third portion and the right-most one-third portion in the width direction is heated by the sinuous-shaped, lower baking element uniformly with food or other substances retained on the cooking vessel in the front-most one-third portion in the depth direction and the center one-third portion in the width direction of the cooking chamber.

2. The oven of claim 1, wherein the oven includes a range top including burners, and a control panel that controls the burners of the range top.

3. An electric resistance heating element for a lower portion of an oven, the oven having an access opening that is selectively opened and closed by an oven door and which defines a front of the oven, the electric resistance heating element comprising:

a sinuous-shaped, lower element formed only by a single continuous wire coupled at a first end to a first plug and at a second end to a second plug, the sinuous-shaped, lower element having a first front side flank portion and a second front side flank portion and at least one front side interior portion, the at least one front side interior portion being disposed intermediate the first front side flank portion and the second front side flank portion as viewed in a width direction perpendicular to the depth direction of the cooking chamber of the oven from the front of the cooking chamber of the oven to the rear of the cooking chamber of the oven and the first front side flank portion and the second front side flank portion each extending closer to the front of the cooking chamber of the oven than the at least one front side interior portion, wherein each of the first front side flank portion, the second front side flank portion, and the at least one front side interior portion includes a semi-circular extent that extends in the depth direction from the rear of the cooking chamber of the oven toward the front of the cooking chamber of the oven and thereafter extends in the depth direction from the front of the cooking chamber of the oven toward the rear of the cooking chamber of the oven, and wherein the semi-circular extent of each of the first front side flank portion, the second front side flank portion, and the at least one front side interior portion is located only in a front-most one-third portion of the oven in the depth direction, wherein the at least one front side interior portion is comprised of a pair of front side interior portions and the front side flank portions and the front side interior portions are semi-circular in cross-sectional shape.

4. The electric resistance heating element for an oven according to claim 3, wherein the front side flank portions are located such that, for each of the front side flank portions, the midpoint thereof along the semi-circular extent of the front side interior portion—which is the location of the front side interior portion closest to the front of the oven—is at the same stand off spacing from the opening access of the oven as the other front side interior portion and the front side interior portions are located such that, for each of the front side interior portions, the midpoint thereof along the semi-circular extent of the front side interior portion is at the same deep pushback spacing from the opening access of the oven as the other front side interior portion.

5. An oven comprising:

a cooking chamber in which a cooking vessel can be disposed for heating of food or other substances retained on the cooking vessel, the cooking chamber having a front-most one-third portion, a middle one-third portion, and a rear-most one-third portion in a depth direction of the cooking chamber, the cooking chamber having a left-most one-third portion, a center one-third portion, and a right-most one-third portion in a width direction of the cooking chamber;

an oven door;

an access opening that is selectively opened and closed by the oven door and which defines the front of the cooking chamber of the oven; and a lower electric resistance heating element disposed in a lower portion of the cooking chamber, the electric resistance heating element formed only by a single continuous wire coupled at a first end to a first plug and at a second end to a second plug, the lower electric resistance heating element having a sinuous-shape and having a first front side flank portion and a second front side flank portion and at least one front side interior portion, the at least one front side interior portion being disposed intermediate the first front side flank portion and the second front side flank portion as viewed in the width direction perpendicular to the depth direction of the cooking chamber of the oven from the front of the cooking chamber of the oven to the rear of the cooking chamber of the oven and the first front side flank portion and the second front side flank portion each extending closer to the front of the cooking chamber of the oven than the at least one front side interior portion, wherein each of the first front side flank portion, the second front side flank portion, and the at least one front side interior portion includes a semi-circular extent that extends in the depth direction from the rear of the cooking chamber of the oven toward the front of the cooking chamber of the oven and thereafter extends in the depth direction from the front of the cooking chamber of the oven toward the rear of the cooking chamber of the oven, and wherein an entire length of the semi-circular extent of each of the first front side flank portion, the second front side flank portion, and the at least one front side interior portion is located only in the front-most one-third portion of the oven in the depth direction such that food or other substances retained on the cooking vessel in the front-most one-third portion in the depth direction and one of the left-most one-third portion and the right-most one-third portion in the width direction is heated by the lower electric resistance heating element uniformly with food or other substances retained on the cooking vessel in the front-most one-third portion in the depth direction and the center one-third portion in the width direction of the cooking chamber.

6. The oven of claim 5, comprising:

a range top having burners; and a control panel that controls the burners of the range top.

7. An electric resistance heating element for a lower portion of an oven, the oven having an access opening that is selectively opened and closed by an oven door and which defines a front of the oven, the electric resistance heating element comprising:

a sinuous-shaped, lower baking element formed only by a single continuous wire coupled at a first end to a first plug and at a second end to a second plug, the sinuous-shaped, lower baking element having a first front side flank portion and a second front side flank portion and at least one front side interior portion, the at least one front side interior portion being disposed intermediate the first front side flank portion and the second front side flank portion as viewed in a width direction perpendicular to the depth direction of the cooking chamber of the oven from the front of the cooking chamber of the oven to the rear of the cooking chamber of the oven and the first front side flank portion and the second front side flank portion each extending closer to the front of the cooking chamber of the oven than the at least one front side interior portion, wherein each of the first front side flank portion, the second front side flank portion, and the at least one front side interior portion includes a semi-circular extent that extends in the depth direction from the rear of the cooking chamber of the oven toward the front of the cooking chamber of the oven and thereafter extends in the depth direction from the front of the cooking chamber of the oven toward the rear of the cooking chamber of the oven, and wherein the semi-circular extent of each of the first front side flank portion, the second front side flank portion, and the at least one front side interior portion is located only in a front-most one-third portion of the oven in the depth direction, an interconnecting portion connecting one of the first front side flank portion and the second front side flank portion to the at least one front side interior portion, wherein the interconnecting portion includes a second semi-circular extent that extends in the depth direction from the front of the cooking chamber of the oven toward the rear of the cooking chamber of the oven and thereafter extends in the depth direction from the rear of the cooking chamber of the oven toward the front of the cooking chamber of the oven, and wherein the second semi-circular extent is located only in a rear-most one-third portion of the oven in the depth direction.

8. An oven comprising:

a cooking chamber in which a cooking vessel can be disposed for heating of food or other substances retained on the cooking vessel;

an oven door;

an access opening that is selectively opened and closed by the oven door and which defines the front of the cooking chamber of the oven;

a lower electric resistance heating element disposed in a lower portion of the cooking chamber, the electric resistance heating element formed only by a single continuous wire coupled at a first end to a first plug and at a second end to a second plug, the lower electric resistance heating element having a sinuous-shape and having a first front side flank portion and a second front side flank portion and at least one front side interior portion, the at least one front side interior portion being disposed intermediate the first front side flank portion and the second front side flank portion as viewed in a width direction perpendicular to the depth direction of the cooking chamber of the oven from the front of the cooking chamber of the oven to the rear of the cooking chamber of the oven and the first front side flank portion and the second front side flank portion each extending closer to the front of the cooking chamber of the oven than the at least one front side interior portion, wherein each of the first front side flank portion, the second front side flank portion, and the at least one front side interior portion includes a semi-circular extent that extends in the depth direction from the rear of the cooking chamber of the oven toward the front of the cooking chamber of the oven and thereafter extends in the depth direction from the front of the cooking chamber of the oven toward the rear of the cooking chamber of the oven, and wherein the semi-circular extent of each of the first front side flank portion, the second front side flank portion, and the at least one front side interior portion is located only in a front-most one-third portion of the oven in the depth direction; and an interconnecting portion connecting one of the first front side flank portion and the second front side flank portion to the at least one front side interior portion, wherein the interconnecting portion includes a second semi-circular extent that extends in the depth direction from the front of the cooking chamber of the oven toward the rear of the cooking chamber of the oven and thereafter extends in the depth direction from the rear of the cooking chamber of the oven toward the front of the cooking chamber of the oven, and wherein the second semi-circular extent is located only in a rear-most one-third portion of the oven in the depth direction.

9. An oven comprising:

a cooking chamber in which a cooking vessel can be disposed for heating of food or other substances retained on the cooking vessel;

an oven door;

an access opening that is selectively opened and closed by the oven door and which defines the front of the cooking chamber of the oven; and a lower electric resistance heating element disposed in a lower portion of the cooking chamber, the electric resistance heating element formed only by a single continuous wire coupled at a first end to a first plug and at a second end to a second plug, the lower electric resistance heating element having a sinuous-shape and having a first front side flank portion and a second front side flank portion and at least one front side interior portion, the at least one front side interior portion being disposed intermediate the first front side flank portion and the second front side flank portion as viewed in a width direction perpendicular to the depth direction of the cooking chamber of the oven from the front of the cooking chamber of the oven to the rear of the cooking chamber of the oven and the first front side flank portion and the second front side flank portion each extending closer to the front of the cooking chamber of the oven than the at least one front side interior portion, wherein each of the first front side flank portion, the second front side flank portion, and the at least one front side interior portion includes a semi-circular extent that extends in the depth direction from the rear of the cooking chamber of the oven toward the front of the cooking chamber of the oven and thereafter extends in the depth direction from the front of the cooking chamber of the oven toward the rear of the cooking chamber of the oven, and wherein the semi-circular extent of each of the first front side flank portion, the second front side flank portion, and the at least one front side interior portion is located only in a front-most one-third portion of the oven in the depth direction, wherein the at least one front side interior portion comprises a pair of front side interior portions.

10. The oven of claim 9, wherein each of the first front side flank portion and the second front side flank portion is located such that a midpoint along the semi-circular extent of each of the first front side flank portion and the second front side flank portion—which is a location of each of the first front side flank portion and the second front side flank portion closest to the front of the cooking chamber—is at a same stand off spacing from the front of the cooking chamber, and wherein each of the pair of front side interior portions are located such that the midpoint along the semi-circular extent of each of the pair of front side interior portions is at a same deep pushback spacing from the front of the cooking chamber.

* * * * *